United States Patent [19]

Morishita et al.

[11] Patent Number: 4,745,777

[45] Date of Patent: May 24, 1988

[54] REFRIGERATING CYCLE APPARATUS

[75] Inventors: Etsuo Morishita, Amagasaki; Keiju Sakaino, Shizuoka; Masayuki Kakuda, Amagasaki, all of Japan

[73] Assignee: Mitsubishi Denki Kabushiki Kaisha, Tokyo, Japan

[21] Appl. No.: 32,281

[22] Filed: Mar. 31, 1987

[30] Foreign Application Priority Data

Mar. 31, 1986 [JP] Japan ..... 61-76146

[51] Int. Cl.[4] ..... F25B 34/09

[52] U.S. Cl. ..... 62/509; 62/510; 62/512

[58] Field of Search ..... 62/119, 509, 510, 512

[56] References Cited

U.S. PATENT DOCUMENTS

| | | | |
|---|---|---|---|
| 2,897,659 | 8/1959 | Wergner | 62/509 |
| 4,359,874 | 11/1982 | McCarty | 62/119 X |
| 4,551,983 | 11/1985 | Atsumi et al. | 62/509 X |

OTHER PUBLICATIONS

Hideo Hirano, "Analysis of Suction Passage Loss in a Rotary Compressor", Matsushita Electic Industrial Co., Ltd., pp. 427–433.

*Primary Examiner*—Lloyd L. King

*Attorney, Agent, or Firm*—Oblon, Fisher, Spivak, McClelland & Maier

[57] ABSTRACT

A refrigerating cycle apparatus of an improved operating efficiency, which is constructed, in combination, with: a refrigerant circuit including an evaporator, a compressor, a condenser, a first throttle, an economizer for separating the refrigerant into a gas phase and a liquid phase, and a second throttle, all these component elements being interconnected in the order as mentioned; and a piping for the economizer, which connects the gas phase portion of the economizer and an intermediate pressure region of the compressor, wherein the length of the economizer is set in such a value that is greater than the values to be determined from a Mollier's diagram on the basis of the operating conditions for the refrigerating cycle apparatus for the increase in the cooling or warming capability as well as the increase in the coefficient of performance.

2 Claims, 9 Drawing Sheets

REFRIGERATING CYCLE APPARATUS

BACKGROUND OF THE INVENTION

1. Field of the Invention

This invention relates to a refrigerating cycle apparatus equipped with an economizer, and, more particularly, it is concerned with increase in the air-conditioning capability and the coefficient of performance of such refrigerating cycle apparatus.

2. Discussion of Background

FIG. 7 of the accompanying drawing is a Mollier's diagram showing a refrigerating cycle, wherein the abscissa denotes an enthalpy h [kcal/kg], and the ordinate represents a pressure p [MPa]. In this graphical representation, a reference letter Pc denotes a condensing pressure [MPa] in the refrigerating cycle, and a reference letter Pe represents an evaporating pressure [MPa] in the refrigerating cycle.

Further, in this graphical representation, a region at the left side of a curve belongs to a liquid phase of the refrigerant, the center part enclosed by the curve denotes a two-phase section, and a region at the right side thereof represents a gas phase. In the drawing, the enthalpy of the refrigerant corresponding to reference numerals 51 to 54 are designated by $h_{51}$ to $h_{54}$ respectively. The refrigerant with its enthalpy of $h_{51}$, when it is compressed by a compressor, turns into a state, in which it has the enthalpy of $h_{52}$. This refrigerant is cooled under a substantially constant pressure in a condenser within the refrigerating cycle apparatus, and then liquefied to be a liquid refrigerant having its enthalpy of $h_{53}$. By means of a throttle provided in the refrigerating cycle apparatus, the liquid refrigerating medium having its enthalpy of $h_{53}$ performs an isenthalpic expansion, whereby the pressure lowers to an evaporating pressure Pe to assume a two-phase state. The enthalpy $h_{54}$ at this time has the identical value with the enthalpy $h_{53}$. The refrigerant in two phases is heated by the evaporator provided in the refrigerating cycle apparatus, and is evaporated. Upon its heating, the liquid refrigerant is again turned into vapor having its enthalpy of $h_{51}$, and is compressed by the compressor. The above is the fundamental principle of the ordinary refrigerating cycle which has been in wide use. By the way, the term "refrigerating cycle apparatus" is used as a general term for a refrigerant cycle apparatus, heat-pump device, vapor-compressing type refrigerating cycle apparatus, and so forth.

Now, in a refrigerator to be used at a high compression ratio, the compression and refrigeration cycle comprises two or more stages, and an economizer is provided at each stage to separate the refrigerant into the gas phase and the liquid phase so as to improve the coefficient of performance in the refrigerating cycle.

FIG. 8 is a conceptual diagram showing a two-stage compression type refrigerating cycle apparatus provided with the economizer. In the drawing, a reference numeral 5 designates an evaporator, a numeral 1 refers to a compressor at a low compression stage side, a numeral 2 refers to a compressor at a high compression stage side, a reference numeral 3 represents a condenser, a reference numeral 6 denotes a first throttle, a numeral 4 refers to an economizer, and a numeral 7 indicates a second throttle, all these component elements being connected in the order as mentioned. The first throttle 6 and the second throttle 7 comprise, for example, expansion valves, capillaries, and so forth. A reference numeral 8 designates a piping for the economizer, which connects the gas phase portion of the economizer 4 and the inlet side of the high compression stage side compressor 2 (i.e., an intermediate pressure region between both low stage side compressor 1 and high stage side compressor 2). In the drawing, reference numerals 51 through 59 represents various states of the refrigerant at its every position as designated. Also, an arrow mark indicates the flowing direction of the refrigerant.

FIG. 9 is a Mollier's diagram of the refrigerating cycle shown in FIG. 8. When this refrigerating cycle is used in the cooling mode, for example, the refrigerant is separated into liquid refrigerant having the enthalpy of $h_{58}$ in its pressure state of Pm within the economizer 4, i.e., liquid phase refrigerant (in the saturated condition) and gas phase refrigerant having the enthalpy of $h_{57}$, i.e., gas phase refrigerant (in the saturated condition), hence the effect of refrigeration in this cycle will be $(h_{51}-h_{59})$. Here, in the case of no economizer being used, the effect of refrigeration will be equivalent to $(h_{51}-h_{56})$, which has the following relationship as is apparently seen from FIG. 8: $(h_{51}-h_{59})>(h_{51}-h_{56})$. As the consequence of this, the cooling capability would increase by the use of the economizer. Moreover, since the input of the refrigerant into the compressor does not increase so much, the refrigerating cycle also increases its coefficient of performance as has been well known.

In the next place, when the cycle in FIG. 9 is used in the heating mode, if an economizer is employed, a flowing quantity g [kg/h] of the gas which has been separated at the intermediate pressure Pm passes through the condenser in addition to a flowing quantity G [kg/h] of the refrigerant which the compressor is able to circulate in the cycle, on account of which the warming capability would increase for the quantity g. In this case, too, since the input of the refrigerant into the compressor does not increase so much, the cycle would augments its coefficient of performance, as has been well known.

As so far been described, both cooling and warming capabilities increase with use of the economizer.

Now, considering the Mollier's diagram in FIG. 9, the following equation is established from the energy relationship on the part of the economizer 4:

$$Gh_{58}+gh_{57}=(G+g)h_{56}.$$

From the above equation, the following relational expression may be derived $$g=\frac{h_{53}-h_{58}}{h_{57}-h_{56}}\cdot G \text{ or} \qquad (i_1)$$

$$G=\frac{h_{57}-h_{56}}{h_{56}-h_{58}}\cdot g. \qquad (i_2)$$

From the above equations $(i_1)$ and $(i_2)$, it will be seen that G and g cannot be independent of each other, but each of them varies in association.

The quantity of gas g [kg/h] flowing from the economizer 4 is usually governed by the diameter of the piping for the economizer. Also, from the Mollier's diagram, it can be explained that the increased quantity $(h_{56}-h_{58}\ (=h_{56}-h_{59}))$ for the refrigerating effect in FIG. 9 becomes large with a lower value of the pressure Pm in the economizer.

FIG. 10 indicates a relationship between the pressure Pm in the economizer and the increased quantity for the refrigerating effect. As is apparent from this graphical representation, the increased quantity ($h_{56}-h_{58}$) for the refrigerating effect can be primarily determined with respect to an arbitrary pressure Pm in the economizer.

The conventional refrigerating cycle provided with the economizer is constructed as mentioned above. However, it has a problem such that, when its operating conditions are set, its operating efficiency on the Mollier's diagram, i.e., increase in the cooling or warming capability, and increase in its coefficient of performance are substantially established, so that it becomes difficult to realize further improvement in the operating efficiency of the refrigerating cycle.

Moreover, the same problem is also present in a refrigerating cycle apparatus such as, for example, a rotary compressor, etc., wherein the refrigerant is supplied to the compressor from a suction muffler to a suction pipe.

SUMMARY OF THE INVENTION

It is therefore an object of the present invention to provide a refrigerating cycle apparatus provided with an economizer having much more improved operating efficiency, and being free from various points of problem as mentioned in the foregoing.

According to the present invention, in one aspect of it, there is provided a refrigerating cycle equipped with an economizer, which comprises in combination: a refrigerant circuit constructed with an evaporator, a compressor, a condenser, a first throttle, an economizer to separate refrigerant into a gas phase and a liquid phase, and a second throttle, all being interconnected in the sequence as mentioned; and a piping for said economizer, which connects the gas phase portion of the economizer and an intermediate pressure region of said compressor, wherein length of said economizer piping is established in such a value that is greater than values, which are to be determined from a Mollier's diagram on the basis of the operating conditions for the refrigerating cycle apparatus, for the increase in the cooling and warming capabilities by said economizer and the increase in the coefficient of performance.

According to the present invention, in another aspect of it, there is provide a refrigerating cycle apparatus equipped with an economizer, which comprises in combination: a refrigerant circuit constructed with an evaporator, a compressor, into which a refrigerant is supplied from a suction muffler through a suction pipe, a condenser, a first throttle, an economizer to separate refrigerant into a gas phase and a liquid phase, and a second throttle, all being interconnected in the sequence as mentioned; and a piping for said economizer having a length sufficient to cause a super-charging phenomenon to take place, which connects the gas phase poriton of said economizer and an intermediate pressure region of said compressor, said suction pipe also having a length sufficient to cause a super-charging phenomenon to take place.

The foregoing object, other objects as well as specific construction and function of the refrigerating cycle apparatus according to the present invention will become more apparent and understandable from the following detailed description thereof, when read in conjunction with the accompanying drawing showing a few preferred embodiments of such refrigerating cycle.

BRIEF DESCRIPTION OF THE ACCOMPANYING DRAWING

DETAILED DESCRIPTION OF PREFERRED EMBODIMENTS

Figure 1:
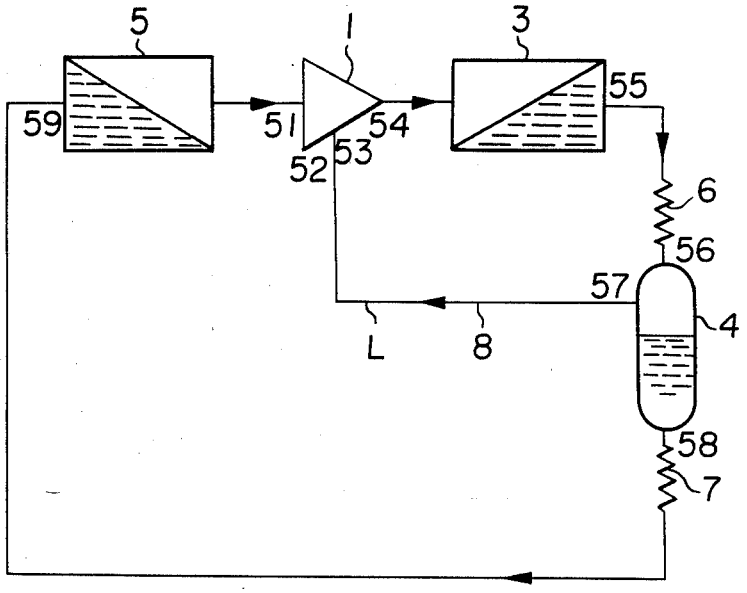
FIG. 1 is a schematic structural diagram of the refrigerating cycle apparatus provided with an economizer according to one embodiment of the present invention.

In the following, the present invention will be described in detail with reference to a few preferred embodiments thereof shown in the drawing.

The piping for the economizer according to the present invention has its length of a value which is greater than the values to be determined from the Mollier's diagram on the basis of the operating conditions of the refrigerating cycle apparatus in respect of increase in the cooling and warming capabilities due to the economizer as well as increase in the coefficient of performance, so that more improvement in the operating efficiency can be attained.

Further according to another embodiment of the present invention, the piping for the economizer is made to have its length such that the super-charging phenomenon of the refrigerating gas may take place therein, and, at the same time, the inlet pipe is also made to have its length such that the super-charging phenomenon may take place therein. As a consequence of this, much more improvement in the operating efficiency can be realized.

Figure 9:
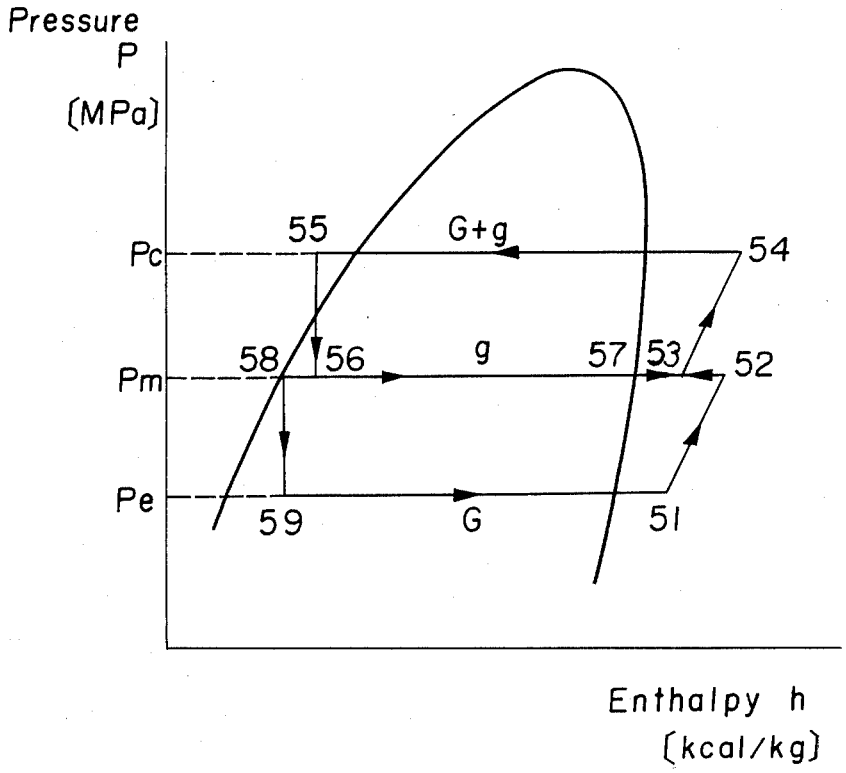
FIG. 9 is a Mollier's diagram in the refrigerating cycle apparatus, as shown in FIG. 8, provided with the economizer.
Figure 10:
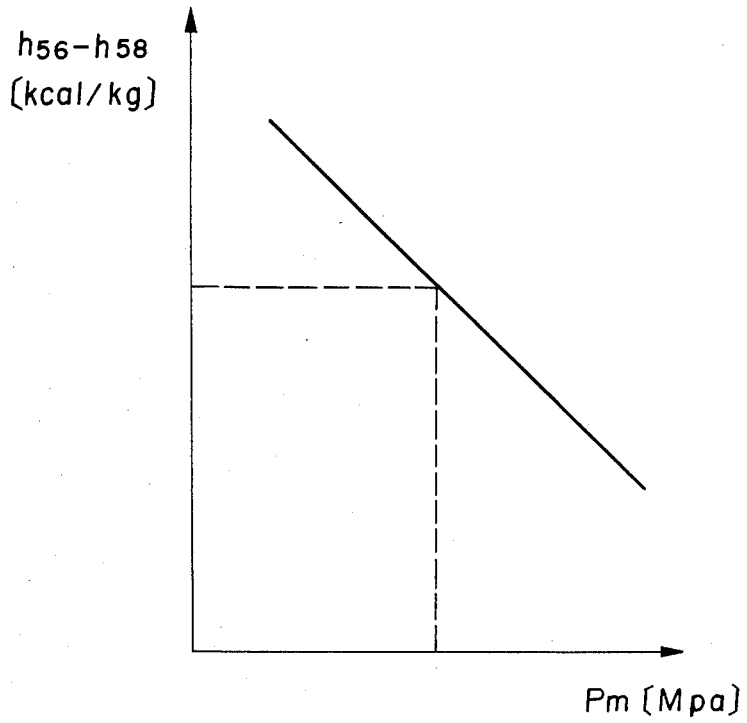
FIG. 10 is a characteristic diagram showing a relationship between increase in the refrigerating effect and pressure in the economizer.

In the following, one embodiment of the present invention will be described in reference to FIG. 1 of the accompanying drawing. In FIG. 1, reference numerals 51 to 59 indicate various states of the refrigerant at its every position, which corresponds to those numerals on the Mollier's diagram shown in FIG. 9.

Figure 8:
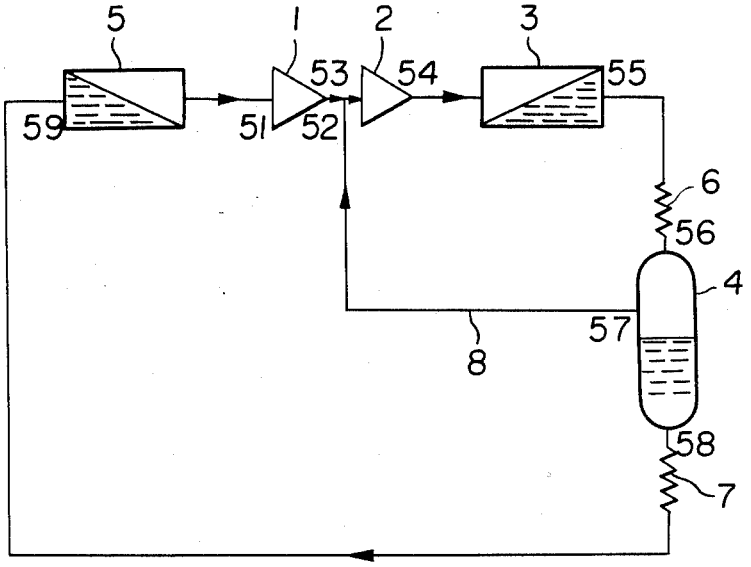
FIG. 8 is a schematic constructional diagram of a conventionally used general two-stage compression type refrigerating cycle apparatus with the economizer being provided therein.

In this embodiment, the compressor 1 is shown to be a single stage, unlike the compressor shown in FIG. 8 having a plurality of compression stages, though it has a structure such that the gas phase refrigerant from the vapor phase portion in the economizer 4 (i.e., the refrigerating gas) can be introduced. As the examples of such compressor, there have been known a rotary compressor (rolling piston type) and a scroll type compressor.

In the refrigerating cycle apparatus equipped with the economizer, the evaporator 5, the compressor 1 (in this embodiment, a scroll type compressor), the condenser 3, the first throttle 6, the economizer 4, and the second throttle 7 are connected each other in the order as mentioned to construct the refrigerating cycle apparatus. Also, the ecenomizer piping 8 connects the gas phase portion of the economizer 4 and the intermediate pressure region of the compressor. Here, "the intermediate pressure region" designates a region in the compressor 1 having a pressure value intermediate between the inlet side and the outlet side thereof.

In the following, the operations of the refrigerating cycle appartus according to this embodiment of the invention will be described. When the compressor 1 is driven by an electric motor or other prime movers, the refrigerating gas is compressed and liquefied in the condenser 3. The thus liquefied refrigerant passes through the first throttle 6 and expands in the economizer 4 where it is separated into gas and liquid. The gaseous refrigerant further passes through the economizer piping 8 to be introduced into the compressor 1. On the other hand, the liquid refrigerant further expands in the second throttle 7, is vaporized in the evaporator 6 and is again taken into the compressor 1.

Now, the present inventors have found out experimentally that, as the result of various studies on the economizer piping and adjustment of the piping length, unusually larger values than those values (which are generally known) for the increase in the cooling or warming capability as well as the coefficient of performance to be primarily determined from the Mollier's diagram on the basis of the operating conditions of the refrigerating cycle apparatus could be obtained. The reason for this is considered to be based on the super-charging phenomenon as shown, for example, in FIG. 3. This super-charging phehomenon can be analyzed from the following mathematical equations.

Figure 2:
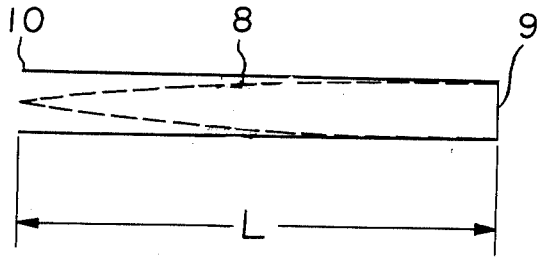
FIG. 2 is an explanatory diagram showing a piping for the economizer having an acoustic resonance length L.

In the above-described embodiment, the length L of the economizer piping 8 is set to be equal to an acoustic resonance length of its vicinity. when a time per one revolution of the compressor 1 is expressed by $\tau_1$ [sec.] and the sonic velocity of the refrigerating gas in the economizer piping 8 is expressed by $a_1$ [m/sec.], the length L of the economizer piping 8 is selected to be about a length to be obtained from the following equation:

$$L \simeq \tfrac{1}{4} \cdot a_1 \cdot \tau_1 \cdot (2N-1) \pm 0.2 [m] \qquad (i_3)$$

where: N=1, 2, 3, . . . . As is well known in the field of aerodynamics or acoustics, the pipe of a length as represented by the above equation ($i_3$) brings about resonance due to the pressure standing-wave occured within it, as shown in FIG. 2, when the pipe has its one end open and the other end closed. In the drawing, a reference numeral 9 designates the closed end of the pipe to the compressor side, a numeral 10 refers to the open end thereof to the economizer side, and dash-lines shown in the economizer piping 8 denotes the pressure standing-wave. While, in practice, the compressor side 9 of the economizer piping 8 is open to the compressor or other component elements, this end part 9 may be considered from the standpoint of physics a boundary, to which a pressure pulsation having a cyclic period of $\tau_1$ [sec.] is imparted. Or, it may also be considered that this end wall 9 of the economizer piping 8 to the compressor side functions as a piston which imparts the same volumetric change as that of the compressing part of the compressor 1, where the economizer piping 8 is open. Considering this, the economizer piping 8 may be acoustically expressed in a model diagram as shown in FIG. 2.

Now, the economizer piping 8 according to this embodiment constantly brings about resonance during operation of the compressor 1, from which it is experimentally found that the flowing quantity g [kg/h] of the refrigerating gas which passes through the economizer piping 8 and flows into the compressor 1 increases on the order of 10% or so in comparison with the case of the non-resonant length thereof. This can also be proven by way of the numerical analysis based on the knowledge of the aerodynamics. In more detail, this can be explained on the basis of the aerodynamic finding such that the pressure pulsation within the economizer piping 8 to occur during its resonance is generated with a timing of supplying the refrigerating gas to the compressor 1 in an excessive amount. This situation is shown by a graphical representation in FIG. 3, in which the abscissa denotes the length L of the economizer piping 8 which has been rendered dimensionless with $a \cdot \tau$, and the ordinate represents the flowing quantity g of the refrigerating gas to be supplied to the compressor 1 from the economizer 4. As is apparent from this graphical representation, the flowing quantity g of the refrigerating gas abruptly increases on the order of about 10% or so with its length corresponding to the acoustic resonance length and its vicinity such as $L=\frac{1}{4} \cdot a_1 \cdot \tau_1$, $\frac{3}{4} \cdot a_1 \cdot \tau_1$, $5/4 \cdot a_1\ \tau_1$, . . . , in comparison with the non-resonance of the piping. Here, as is evident from the Mollier's diagram in FIG. 9, the refrigerating gas in the quantity of g passes through the condenser 3, so that the warming capability of the refrigerating cycle can be increased for the increase of g[kg/h], in the case the length L of the economizer piping corresponds to the resonating length. It has also been found from the experiment that the increase in the input of the refrigerating gas into the compressor 1 is small for the increase in the flowing quantity g of the refrigerant, hence the coefficient of performance improves.

In the next place, from the equation ($i_2$), the following relationship was established:

$$G = \frac{h_{57} - h_{58}}{h_{56} - h_{58}} \cdot g. \qquad (i_2)$$

In the case, however, of the operating conditions of the refrigerating cycle being constant, the following relationship will be established:

$$G \alpha g \qquad (i_4).$$

Figure 3:
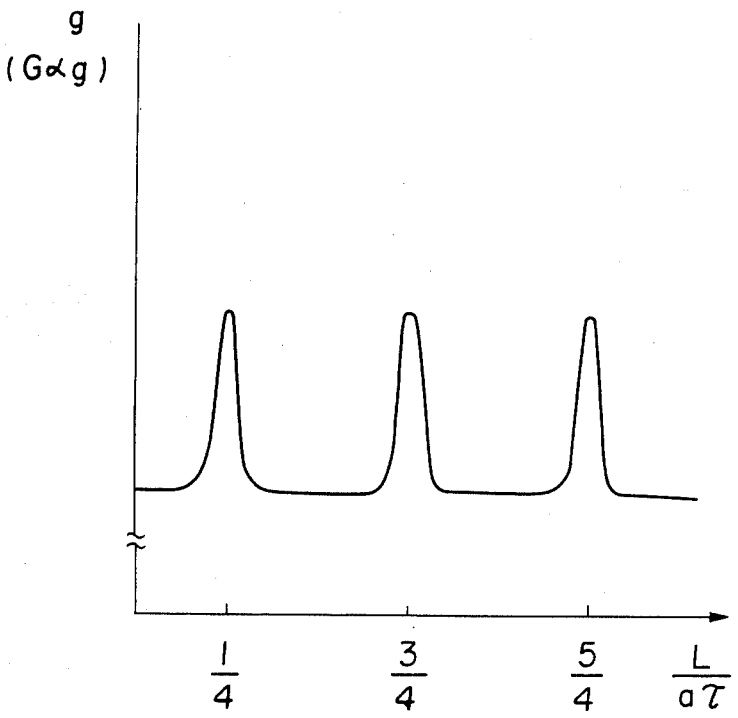
FIG. 3 is a characteristic diagram showing a relationship between length of the economizer piping and quantity g of the gas phase refrigerant.

Whereby it is understood that, when the length L of the economizer 8 is the resonating length, the flowing quantity g of the refrigerant abruptly increases as shown in FIG. 3, and that G also should increase abruptly in accordance with the above equation ($i_4$). As the consequence of this, the cooling capability also could abruptly increases. According to the experimental verification, since the increase in the input of the refrigerant into the compressor is small in comparison with the ratio of the cooling capability increasing abruptly, the coefficient of performance also improves in the case of the cooling mode.

Incidentally, according to the experiment, there could be observed the super-charging phenomenon as shown in FIG. 3 within an extent of ±25 cm of the acoustic resonance length. Experimentally, since remarkable effect can be recognized within an extent of ±20 cm of the acoustic resonance length, the length L of the economizer piping was established as mentioned in the foregoing, on the basis of the above-mentioned equation ($i_3$), i.e., $L \simeq \frac{1}{4} \cdot a_1 \cdot \tau_1 \cdot (2N-1) \pm 0.2$ [m] where: $N=1, 2, 3, \ldots$.

Figure 4:
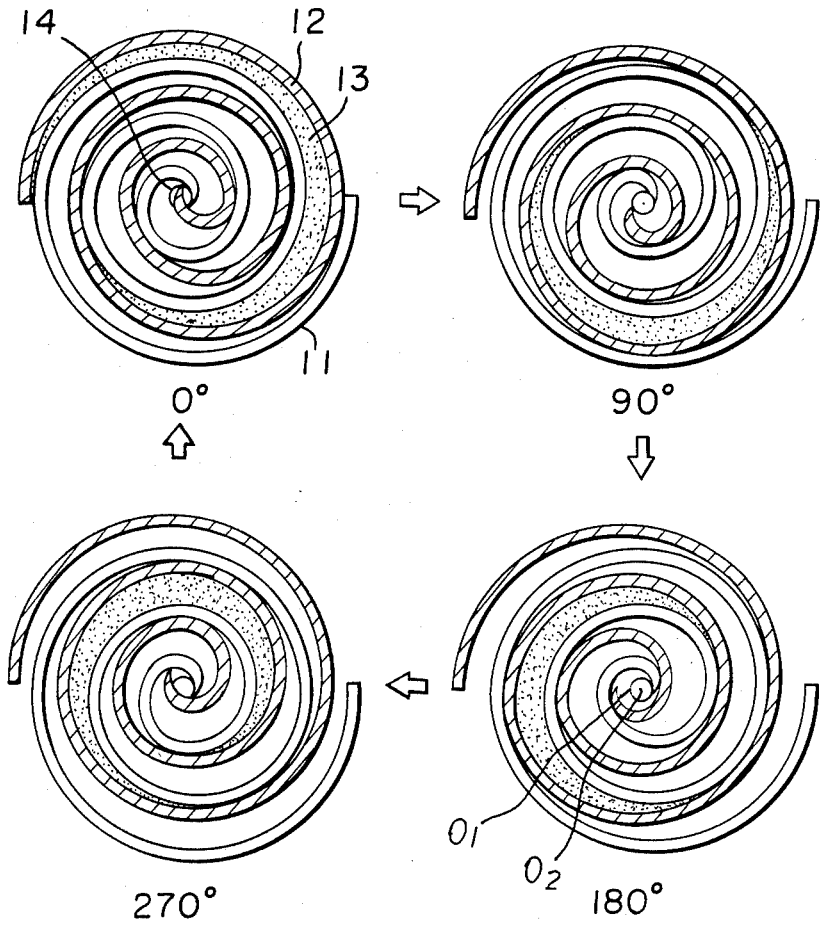
FIG. 4 is an explanatory diagram showing the operating principle of a scroll type compressor.
Figure 5:
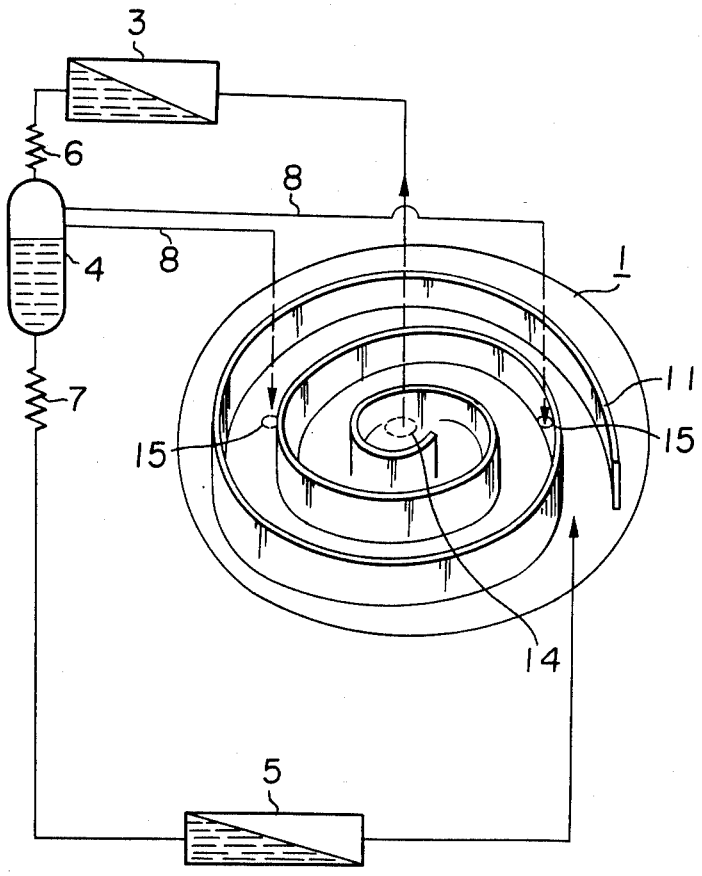
FIG. 5 is a schematic structural diagram showing the refrigerating cycle apparatus according to one embodiment of the present invention.

In the foregoing explanations of the embodiment according to the present invention, the theoretical aspect thereof has been given, which will be amplified in more detail in reference to FIGS. 4 and 5.

FIG. 4 is a diagram showing the operating principle of the scroll type comressor 1 which is used in one embodiment of the present invention. In the drawing, a reference numeral 11 designates a stationary scroll, a numeral 12 refers to an orbiting scroll, a numeral 13 denotes a compressor, and 14 represents an outlet port. Both stationary scroll 11 and orbiting scroll 12 are formed in the same spiral shape, which has a shape of on involute, arc, and others in combination, as has been known conventionally. A reference letter $0_1$ designates a fixed point on the stationary scroll, while a reference letter $0_2$ denotes a fixed point on the orbiting scroll.

In the following, explanations will be given as to operations of this scroll type compressor. The orbiting scroll 12 is combined with the stationary scroll 11 as shown in the drawing without changing its posture with respect to the open space and moves in rotation (i.e., performs its orbiting motion), thereby changing its position at the respective moving angles of 0° C., 90°, 180° and 270°, as shown in FIG. 4. With the movement the orbiting scroll 12, a compression chamber 13 in the form of a crescent to be defined between the stationary scroll 11 and the orbiting scroll 12 sequentially reduces its volume, whereby a gas confined in this compression chamber 14 is compressed and discharged from the outlet port 14. During this compression stroke, a distance between the fixed points $0_1-0_2$ in FIG. 4 is maintained constant, and, if a pitch of the spiral is taken P and thickness thereof is denoted as t, the distance $(0_1-0_2)$ is represented as $0_1-0_2=P/2-t$. The scroll type compressor operates in the above-described manner. For further details, reference may be had to unexamined Japanese Patent publication No. 046081/1980.

FIG. 5 is a schematic structural diagram, in which the economizer 4 is provided on the scroll type compressor 1 as illustrated in FIG. 4. This construction corresponds to the above-described embodiment of the refrigerating cycle apparatus according to the present invention as shown in FIG. 1, in which a reference numeral 15 designates inlet ports. As may be understood from FIG. 4, since the compression chamber 13 in the scroll type compressor is formed with a pair of similar scroll members, the inlet port 15 is also formed in pair. In correspondence to this, the economizer piping 8 reaching each of the inlet ports 15 is also provided in pair, the length of which corresponds to the acoustic resonance length or its neighborhood to be determined from the afore-described equation ($i_3$). Here, the refrigerating gas which has been separated into the gas phase and the liquid phase by the economizer 4 is supplied to the compression chamber 13 of the compressor 1 through the pair of inlet ports 15 by way of the pair of ecomomizer pipings 8. At this instant, there takes place the super-charging phenomenon whithin the ecomomizer pipings, whereby the flowing quantity g [kg/h] of refrigerating gas abruptly increases, hence the cooling or warming capability as well as the coefficient of performanec of the refrigerating cycle increase as already mentioned in the foregoing. According to the results of experiment, when use is made of "R-22" as the refrigerant, the increase in the cooling capability as well as the coefficient of performance at 60 Hz is as shown in the following Table 1.

TABLE 1

Comparison In Cooling Capability And Coefficient Of Performance Between Refrigerating Cycle Apparatus Provided With Economizer Having Economizer Piping Of A Length Corresponding To Acoustic Resonance Length Or Its Vicinity And Refrigerating Cycle Not Provided With Economizer

| | Cooling Capability Q [kcal/h] | Coefficient of Performance |
|---|---|---|
| Without economizer | 12500 | 2.80 |
| With Economizer and economizer piping | 13750 | 3.08 |
| With economizer having economizer piping of a length corresponding to the acoustic resonance length or its vicinity (3.7 m or so) | 17000 | 3.60 |

As is apparent from Table 1 above, the cooling capability and the coefficient of performance are seen to have increased by 36% and 29%, respectively, with the refrigerating cycle apparatus having the economizer, as contrasted to the refrigerating cycle apparatus having no economizer. This increase is fairly greater than the theoretical and empirical increase in the cooling capability and the coefficient of performance of the refrigerating cycle apparatus having ordinary economizer and economizer piping, which is shown in Table 1 above to be 24% and 17%, respectively, for the cooling capability and the coefficient of performance.

Figure 6:
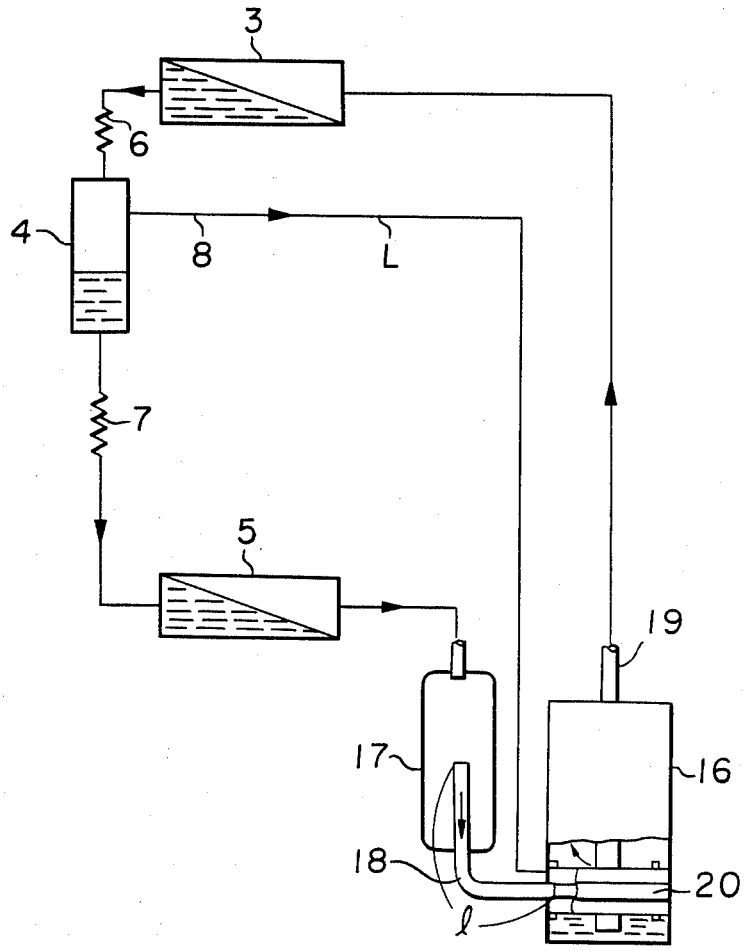
FIG. 6 is a schematic structural diagram showing another embodiment of the refrigerating cycle apparatus according to the present invention.
Figure 7:
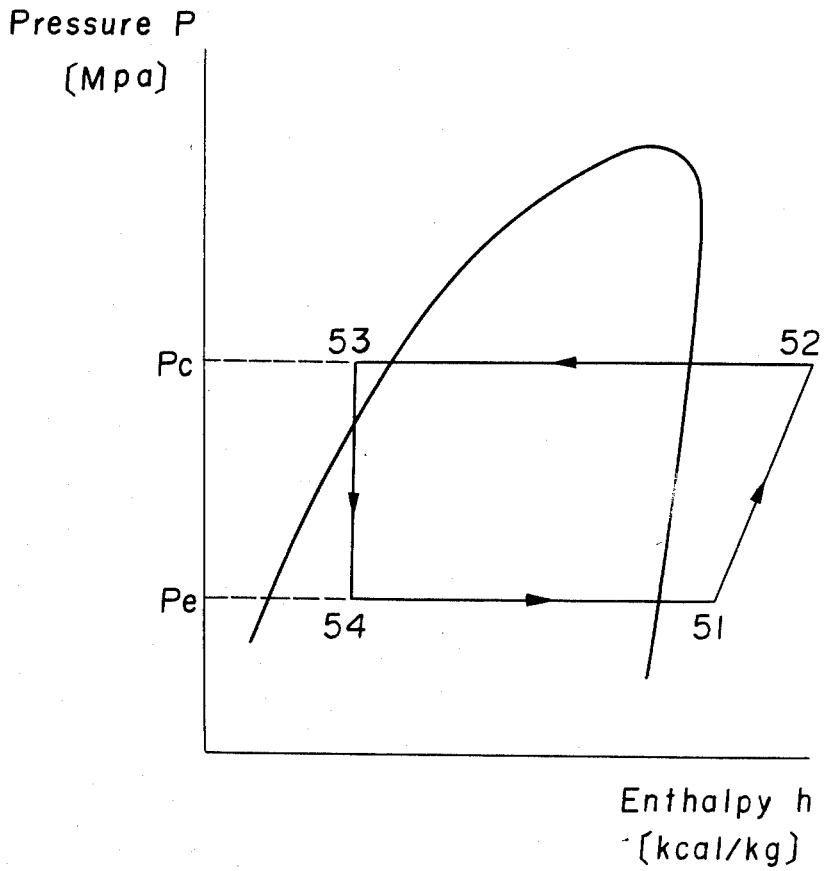
FIG. 7 is a Mollier's diagram in a general refrigerating cycle apparatus without the economizer being provided therein.

FIG. 6 illustrates another embodiment of the refrigerating cycle apparatus according to the present invention, in which a reference numeral 16 designates a rotary compressor, a numeral 17 refers to a suction muffler, 18 denotes a suction pipe, 19 an outlet pipe, and 20 a compression chamber.

In this embodiment of the refrigerating cycle apparatus, the evaporator 5, the compression chamber 20 of the rotary compressor 16, into which the refrigerant is supplied from the suction muffler 17 through the suction pipe 18, the condenser 3, the first throttle 6, the economizer 4, and the second throttle 7 are interconnected in the sequence as mentioned. This refrigerating cycle apparatus is also provided with the economizer piping 8 which connects the gas phase portion of the economizer 4 and the intermediate pressure region of the compressor 16, and has its length sufficient to bring about the super-charging phenomenon. For instance, when the cylic period per one revolution of the compressor is taken $\tau_1$ [sec.] and the sonic velocity of the gas-phase refrigerant within the economizer piping or its neighborhood is taken as $a_1$ [m/s], the length L of the economizer piping will be determined from the following equaiton:

$$L=\tfrac{1}{4}\cdot a_1\cdot\tau_1\cdot(2N-1)\pm0.2\ [m]$$

where: N=1, 2, 3, . . . .

In case the operating conditions of the refrigerating cycle apparatus have been known, the following relationship may be established from the equation ($i_4$):

$$g\propto G \qquad (G\alpha g) \qquad (i_4).$$

Now, in the refrigerating cycle apparatus shown in FIG. 6, if it is assumed that the length 1 of the suction pipe of the rotary compressor 16 is equivalent to the acoustic resonance length to be determined by the cyclic period $\tau_2$ [sec.] per one revolution of the compressor and the sonic velocity $a_2$ [m/s] of the refrigerant in the suction pipe 18, the length of which is represented by the following equation ($i_5$):

$$1=\tfrac{1}{4}\cdot a_2\cdot\tau_2\cdot(2N-1)\pm0.2\ [m] \qquad (i_5)$$

where: N=1, 2, 3, . . . , it has been found both experimentally and analytically that the quantity G [kg/h] of the refrigerating gas to be introduced into the rotary compressor 16 abruptly increases by the super-charging phenomenon. This state is as same as the case shown in FIG. 3. Accordingly, when the length 1 of the suction pipe is set to be equal to the acoustic resonance length or its vicinity, the cooling capability of the refrigerating cycle apparatus would increase due to increase in the quantity G of the refrigerating gas. Further, from the relationship in the equation (i4), the quantity g [kg/h] of the refrigerating gas passing through the economizer piping 8 also increases with the consequence that the warming capability of the refrigerating cycle apparatus also increases.

In this embodiment of FIG. 6, the length L of the economizer piping 8 and the length 1 of the suction pipe 18 of the rotary compressor are both set to be equal or approximate to the acoustic resonance length, whereby the quantity G of the refrigerating gas to be introduced into the rotary comressor and the quantity g of the refrigerating gas passing through the economizer piping are both increased with the result that the cooling or warming capability of the refrigerating cycle apparatus further increases.

As has so far been described, the refrigerating cycle apparatus of the present invention provides a meritorious effect such that it is able to realize increase in the cooling or warming capability as well as the coefficient of performance.

What is claimed is:

1. A refrigerating cycle apparatus which comprises in combination: a refrigerant circuit constructed with an evaporator, a compressor, a condenser, a first throttle, an economizer for separating said refrigerant into a gas phase and a liquid phase, and a second throttle, all being interconnected in the sequence as mentioned; and a piping for said economizer, which connects the gas phase portion of said economizer and an intermediate pressure region of said compressor, wherein the length L of said economizer piping is set to satisfy the following relationship:

$$L=\tfrac{1}{4}\cdot a_1\cdot\tau_1\cdot(2N-1)\pm0.2\ (m)$$

where: $a_1$ (m/s) denotes a sonic velocity of the refrigerant in the gas phase within the economizer piping or in its vicinity; $\tau_1$ (sec.) is a cyclic period per one revolution of the compressor; and N is an integer of 1, 2, 3, . . . , whereby the coefficient of performance of the refrigerating cycle apparatus is increased due to the super-charging phenomenon.

2. A refrigerating cycle apparatus, which comprises in combination:

a refrigerant circuit constructed with an evaporator, a compressor, into which a refrigerant is supplied from a suction muffler through a suction pipe, a condenser, a first throttle, an economizer for separating said refrigerant into a gas phase and a liquid phase, and a second throttle, all being interconnected in the sequence as mentioned; and a piping for said economizer, which connects the gas phase portion of said economizer and an intermediate pressure region of said compressor wherein the length l of said suction pipe is set to satisfy the following relationship:

$$l=\tfrac{1}{4}\cdot a_2\cdot\tau_2\cdot(2N-1)\pm0.2\ (m)$$

wherein: $a_2$ (m/s) is a sonic velocity of the refrigerant in the gas phase within the inlet pipe of the compressor or in its vicinity; $\tau_2$ (sec.) is a cyclic period per one revolution of the compressor; and N is an integer of 1, 2, 3, . . . , wherein the length L of said economizer piping is set to satisfy the following relationship:

$$L=\tfrac{1}{4}\cdot a_1\cdot\tau_1\cdot(2N-1)\pm0.2\ (m)$$

where: a 1 (m/s) is a sonic velocity of the refrigerant in the gas phase within said economizer piping or in its vicinty; $\tau 1$ (sec.) denotes a cyclie period per one revolution of the compressor; and N is an integer of 1, 2, 3, . . . , whereby the coefficient of performance of the refrigerating cycle apparatus is increased due to the super-charging phenomenon.

* * * * *